US012735868B2

(12) United States Patent
Gateau et al.

(10) Patent No.: US 12,735,868 B2
(45) Date of Patent: Sep. 15, 2026

(54) CONSTRUCTION EQUIPMENT

(71) Applicant: Volvo Construction Equipment AB, Eskilstuna (SE)

(72) Inventors: Alexandre Gateau, Tresserve (FR); Kim Heybroek, Kvicksund (SE); Ludovic Maxant, Viviers du Lac (FR); Frederic Broizat, Chezeneuve (FR); Gauthier Brunet, Lyons (FR)

(73) Assignee: Volvo Construction Equipment AB, Eskilstuna (SE)

( * ) Notice: Subject to any disclaimer, the term of this patent is extended or adjusted under 35 U.S.C. 154(b) by 372 days.

(21) Appl. No.: 18/206,246

(22) Filed: Jun. 6, 2023

(65) Prior Publication Data

US 2023/0392349 A1 Dec. 7, 2023

(30) Foreign Application Priority Data

Jun. 7, 2022 (EP) ..... 22177543

(51) Int. Cl.
*E02F 9/20* (2006.01)

(52) U.S. Cl.
CPC ..... *E02F 9/2095* (2013.01); *E02F 9/202* (2013.01)

(58) Field of Classification Search
CPC ..... E02F 9/202; E02F 9/2095; E02F 3/422; E02F 3/425
See application file for complete search history.

(56) References Cited

U.S. PATENT DOCUMENTS

| | | | | |
|---|---|---|---|---|
| 3,664,527 | A * | 5/1972 | Short | E02F 3/32 414/718 |
| 10,355,554 | B2 * | 7/2019 | Parmar | F16H 25/20 |
| 2016/0090710 | A1 * | 3/2016 | Takemura | E02F 3/422 414/685 |
| 2017/0335541 | A1 * | 11/2017 | Caillieret | E02F 3/32 |
| 2018/0287458 | A1 * | 10/2018 | Parmar | H02K 7/116 |

FOREIGN PATENT DOCUMENTS

| | | | | |
|---|---|---|---|---|
| CN | 110984263 | A | 4/2020 | |
| CN | 115142488 | A * | 10/2022 | E02F 3/425 |
| EP | 4036317 | A1 | 8/2022 | |
| WO | WO-2013114451 | A1 * | 8/2013 | H02K 7/06 |
| WO | WO-2016097784 | A1 * | 6/2016 | E02F 3/425 |
| WO | WO-2022168582 | A1 * | 8/2022 | E02F 3/32 |

OTHER PUBLICATIONS

Extended European Search Report for European Patent Application No. 22177543.0, mailed Dec. 8, 2022, 3 pages.
Communication pursuant to Article 94(3) EPC for European Patent Application No. 22177543.0, mailed Sep. 22, 2025, 7 pages.

* cited by examiner

*Primary Examiner* — Vishal R Sahni
(74) *Attorney, Agent, or Firm* — Sage Patent Group

(57) ABSTRACT

A construction equipment is provided with at least one electric actuator including an electric motor and a mechanism for transmitting the torque of the electric motor to an element of the construction equipment, such as boom, dipper or tool, in order to move it in desired direction, wherein said mechanism includes a damper rod.

10 Claims, 4 Drawing Sheets

CONSTRUCTION EQUIPMENT

CROSS REFERENCE TO RELATED APPLICATION

This application claims foreign priority to European Application No. 22177543.0 filed on Jun. 7, 2022, the disclosure and content of which is incorporated by reference herein in its entirety.

TECHNICAL FIELD

The disclosure relates to a construction equipment, specifically to a fully electrically driven construction equipment.

The disclosure is applicable on working machines within the fields of industrial construction machines or construction equipment, in particular excavators and articulated haulers. Although the disclosure will be mainly described with respect to an excavator, the disclosure is not restricted to this particular machine, but may also be used in other working machines such as articulated haulers, dump truck and backhoe loaders, loaders, skid steer loaders, as far as it is equipped of linear cylinders to drive the movement of the equipment.

BACKGROUND

In recent years, there has been a clear trend towards the electrification of vehicles, and thus a move away from the use of fossil fuels that cause greenhouse gas emissions. Electric vehicles also have the advantage of being much quieter than their thermal counterparts.

This trend is now spreading to construction machinery which, until now, has included a combustion engine driving a hydraulic pump. Gradually, internal combustion engines will be replaced by electric motors. There are also solutions to replace the hydraulic system and the various cylinders that make it up. Today, the solution mainly consists of replacing the hydraulic cylinders with electric cylinders. In practice, however, this poses many problems, including bulk, exposure to shocks and above all potentially irreversible deformation or wear, or even breakage, caused by the induced forces.

It is well known that during certain operations, such as the digging or dumping phases, some parts of the construction equipment are exposed to shocks. Traditionally, i.e. with hydraulic cylinders, the volume of oil inside cylinder and overall circuit can be compressed and thus absorb the shocks. However, and to the knowledge of the Applicant, nobody has so far succeeded in solving this problem with electric cylinders, with performances similar to that of hydraulic cylinders.

SUMMARY

An object of the disclosure is to provide a simple and efficient solution to absorb the shocks to which is exposed the construction equipment and therefore to avoid that the shocks are transmitted to sensitive parts of the electric actuators, e.g. E-motor and ball or roller screw mechanisms. This enables to offer a fully electric solution with a performance level similar to that obtained with traditional hydraulic cylinders.

The object is achieved by a construction equipment according to claim 1.

Another object of the disclosure is to provide a robust solution to replace hydraulic cylinders of a construction equipment with electric actuators. In detail, the integration of the actuator(s) inside the equipment offers large possibilities to fit the components of the actuator(s) and adopt an appropriate sizing. This solution will make it possible to propose fully electrically driven construction equipment on the market.

The electric actuator(s) with which the construction equipment according to the disclosure is equipped are build up from simple elements "off the shelf" whose performance, durability and efficiency have been proven in the past. Moreover, the guiding means and the integration of sensitive elements of the actuators into the construction equipment enables to achieve very promising results in terms of robustness, durability and efficiency.

Moreover, and thanks to the usage of an electric motor, energy recovery can be applied through the electric motor acting as generator, during driven movements, typically when excavator boom is moving down under gravity.

Advantageous, but optional features of the disclosure are depicted in claims 2 to 10.

BRIEF DESCRIPTION OF THE DRAWINGS

With reference to the appended drawings, below follows a more detailed description of embodiments of the disclosure cited as examples.

In the drawings.

DETAILED DESCRIPTION OF EXAMPLE EMBODIMENTS OF THE DISCLOSURE

Figure 1:
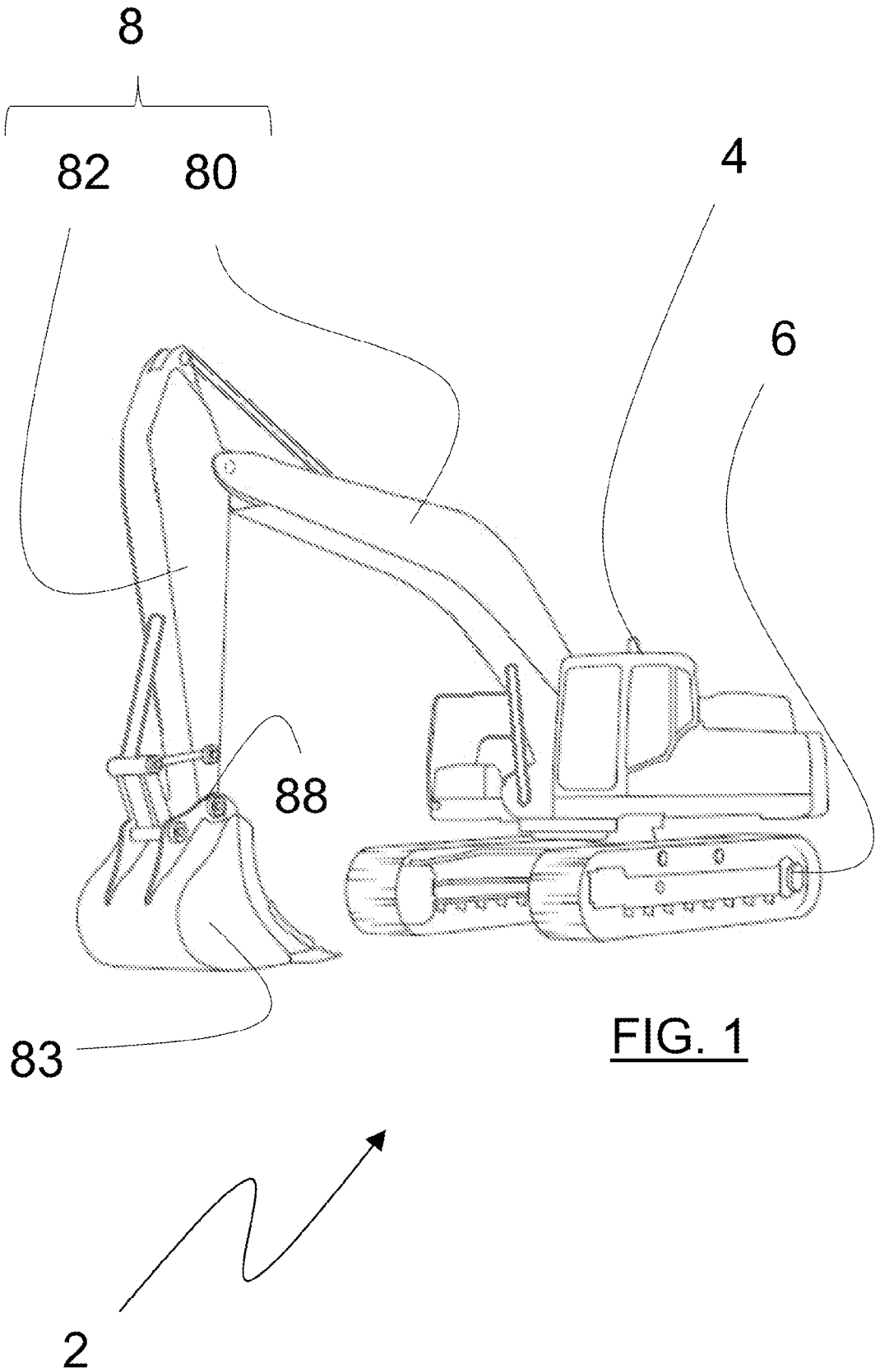
FIG. 1 is a perspective view of a construction equipment, e.g. an excavator, according to the disclosure.

FIG. 1 shows a construction equipment 2 (also referred to as a "construction machine" or "work machine"), which in the example is an excavator. Obviously, and as mentioned above, the disclosure is not limited to this particular example as it can be applied to any other construction machine.

The construction machine 2 comprises an upper frame (also known as "platform") 4 that can be pivoted around a vertical axis. The upper frame 4 includes the driver cab. It is rotationally mounted on a lower frame equipped with a pair of continuous tracks 6, e.g. caterpillars tracks 6.

The excavator 2 further includes an excavator arm 8, which comprises a boom 80 that is rotatable relative to the upper frame 4 and a dipper 82 (also known as "stick" or "arm") that is rotatable relative to the boom 80. Besides, a tool 83, such as a bucket, is removably attached to the end of the dipper 82.

Figure 2:
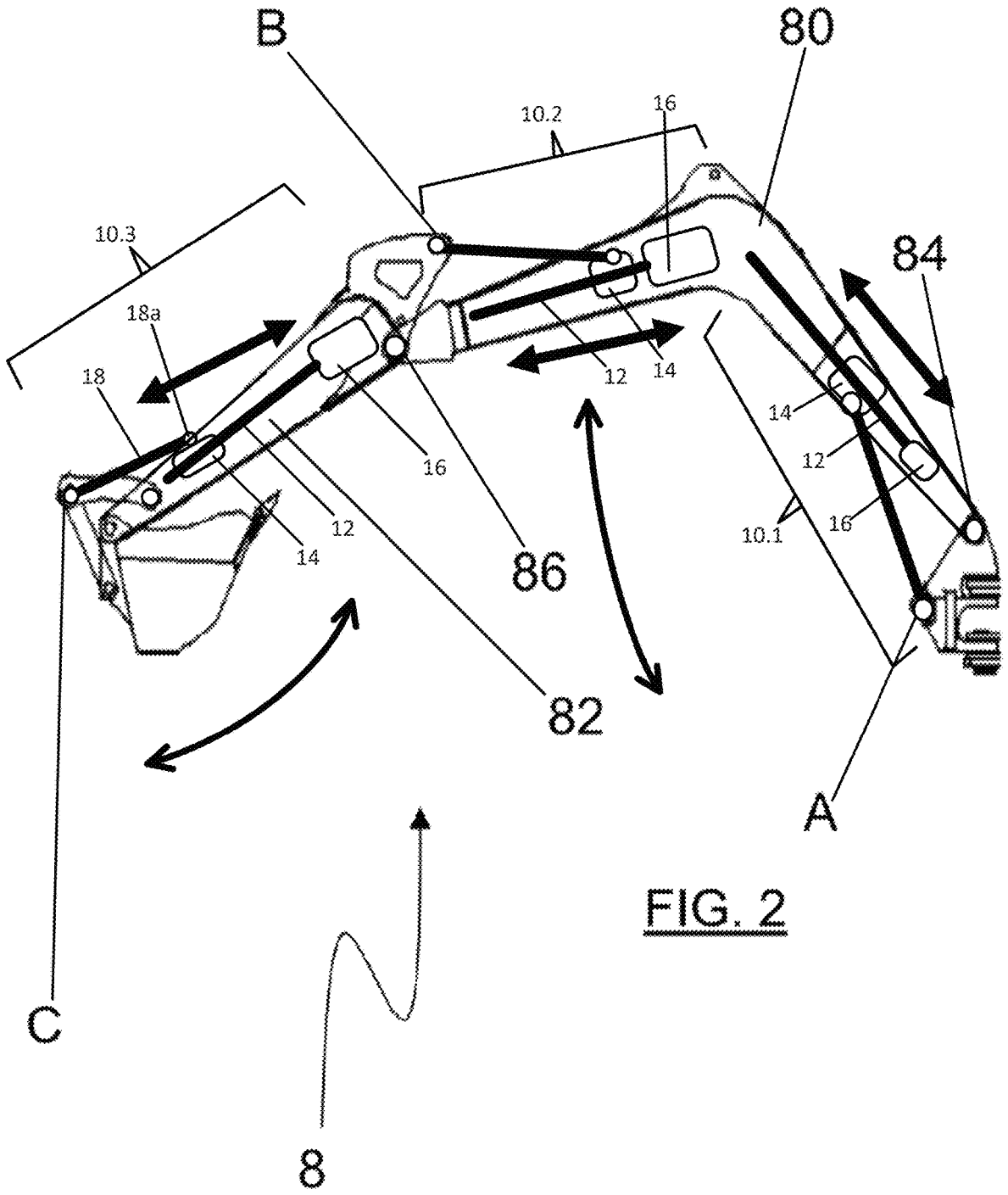
FIG. 2 is a cross-section view of the excavator arm, including a boom, a dipper and bucket.

In reference to FIGS. 1 and 2, Numeral reference 84 denotes the articulation (or hinge) between boom 80 and upper frame 4, Numeral reference 86 denotes the articulation (or hinge) between boom 80 and dipper 82 and Numeral reference 88 denotes the articulation between tool 83 and dipper 82 (Cf. FIG. 1).

In known manner, the articulations 84, 86 and 88 allow rotating the boom 80, dipper 82 or tool 83 around an axis of rotation parallel to the ground surface. Accordingly, when the construction equipment lays on a flat surface, said axis or rotation is horizontal. However, in variant, some construction equipment include articulation(s), linked to actuator(s), whose axis of rotation is not parallel to the ground.

In the example, the boom 80 is angle-shaped, which means that it includes two straight segments that delimit between them an angle of approximately 120°.

The construction machine 2 is specific in that it is entirely electric. In other words, the construction machine 2 has neither a thermal engine, nor hydraulics. The continuous tracks 6 are driven by at least two electric motors (not shown), respectively one for each track 6, and the movements of the excavator arm 8 and tool 83 are achieved thanks to electric actuators, respectively three electric actuators 10.1, 10.2 and 10.3.

Figure 3:
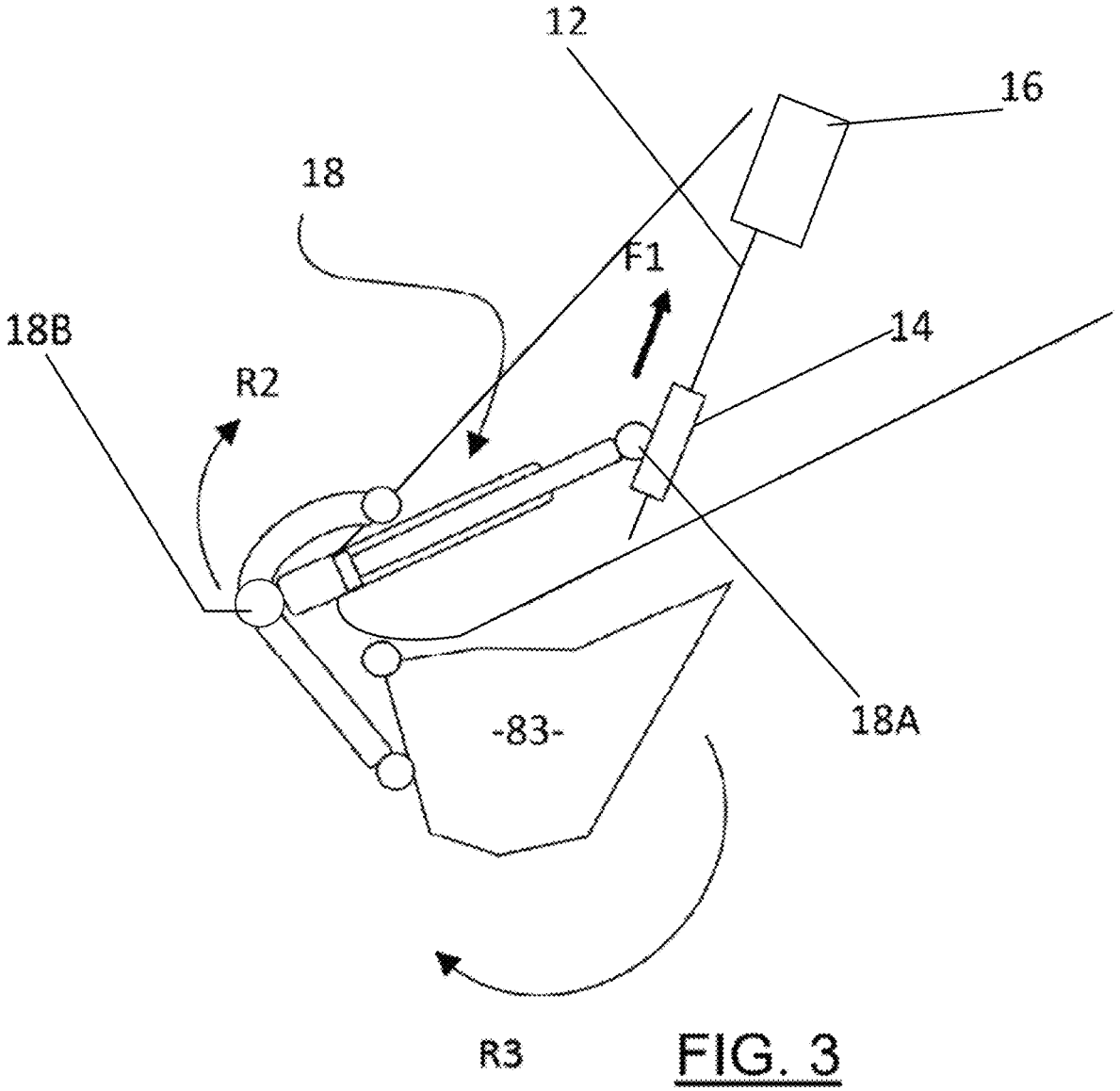
FIG. 3 is a cross-section view detailing more deeply the operation of excavator bucket by electric actuator.

As shown on FIG. 3, each actuator comprises an electric motor 16 and a mechanism for transmitting the torque of the electric motor 16 to an element of the construction equipment, such as boom or dipper, in order to move it in the desired direction. Advantageously, said mechanism includes a damper rod 18 (also known as "shock absorber") that allows to absorb any shock applied to the construction equipment and therefore to avoid exposing the electric motor and/or the ball or roller screw mechanism and/or guiding means to mechanical stress and damage.

In the example of FIG. 3, damper rod 18 consists of two imbricated cylinders, respectively an inner cylinder capable of moving longitudinally inside an outer cylinder. A chamber of compression is therefore defined inside outer cylinder. Said chamber can be compressed when a strong or brutal axial force is applied to damper rod, e.g. after a shock. In such event, inner cylinder retracts inside or extends outside outer cylinder, making the chamber of compression to compress. After the shock has been absorbed, the two imbricated cylinders come back to their original position. The chamber of compression (which is sealed) can be filled up with a gas or liquid (such as oil). According to a variant not shown, damper rod 18 delimits another chamber filled of liquid or gas to absorb shock induced by traction effort. Typically, the two chambers to which it is referred to are separated by a piston. Accordingly, shock absorption can be achieved in the two directions (traction and compression).

In a variant not shown, the chamber(s) of compression includes one or more compression spring(s) with high resistance, so that compression spring is compressed only when the axial force to which it is subjected exceeds some threshold. Said threshold is chosen so that the spring is compressed only in some circumstances, for example during a shock. The compression spring(s) to which it is referred to above can be preloaded or not.

Therefore, in normal conditions of operation, damper rod 18 behaves as a rigid bar. In case of shock, damper rod 18 retracts or extends to absorb the shock. In other word, inner cylinder retracts inside or extends outside outer cylinder under the effect of the force generated by the shock and said force is absorbed by the displacement of inner cylinder.

Shock absorbers are known from long time ago and are therefore part of general knowledge, which is why no further details are depicted in this paper.

The mechanism to which it is referred to above further includes a rod 12, extending along a longitudinal axis X12 and a sliding member 14 (which can also be called "carriage") configured for moving along rod 12 upon activation of the electric motor.

Typically, sliding member 14 and rod 12 are connected one with the other through a ball or roller screw connection, meaning that rod 12 includes threads in which are received a multitude of rolling elements, such as balls, and sliding element 14 is fixed to a nut comprising internal threads complementary to that of rod 12. Rod 12 is rotationally coupled with output shaft of motor 16.

Accordingly, activation of motor 16 leads to a rotation of rod 12 around its axis X12 and therefore to a displacement of sliding element 14 back or forth, depending on rotation direction of output shaft of motor 16.

Advantageously, damper rod 18 comprises a first end 18A which is articulated on sliding member 14 and a second end 18B which is articulated on a first element of the construction equipment, in order to move the first element relative to a second element or inversely.

In the example, first end 18A belongs to inner cylinder of damper rod 18, while second end 18B belongs to outer cylinder but contrary is also possible.

Figure 4:
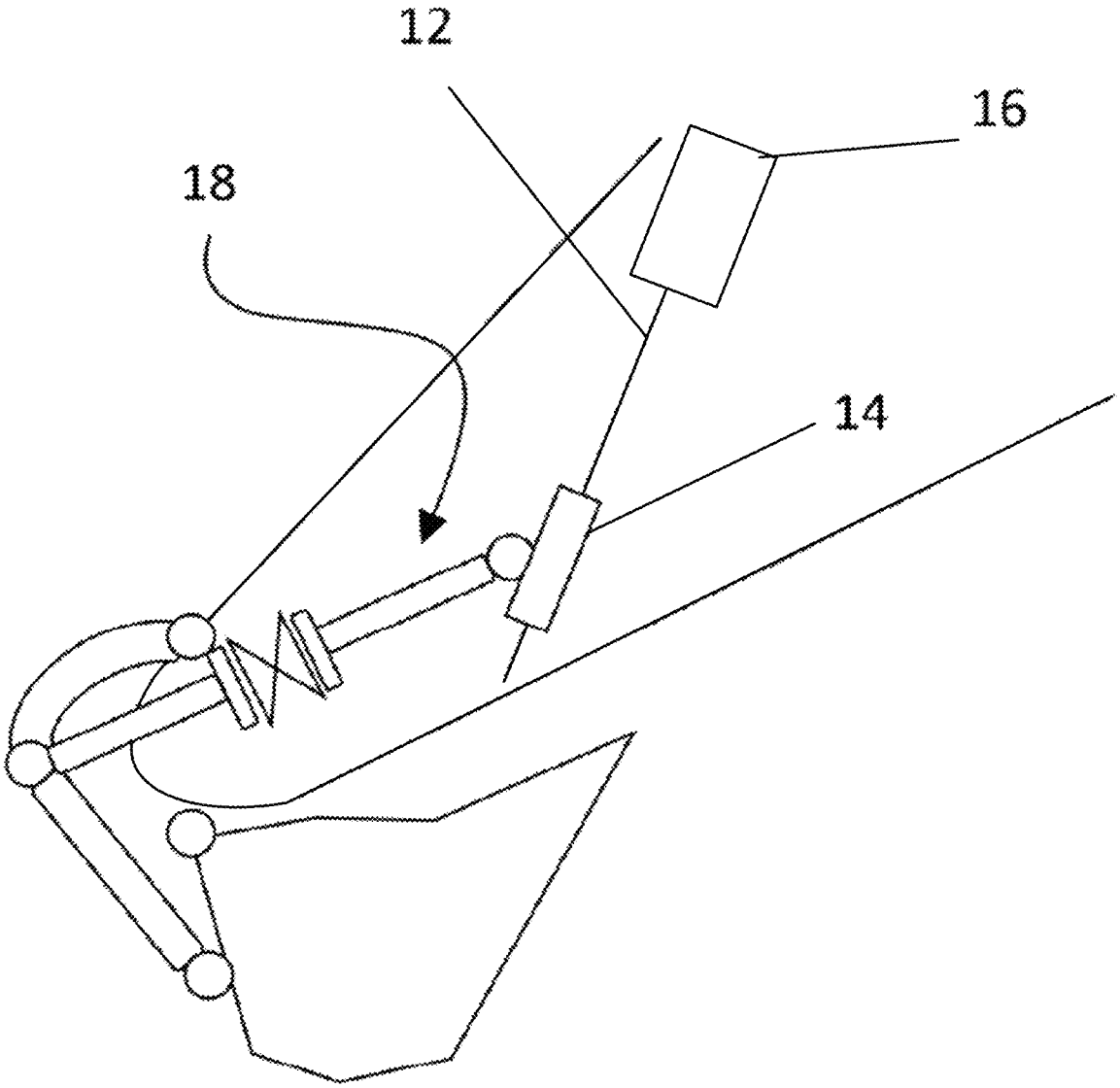
FIG. 4 is a cross-section view similar to FIG. 3 representing an alternative embodiment.

On FIGS. 3 and 4, linkages representing pivot points are represented by circles/rounds.

In detail, and in reference to FIG. 3, the activation of E-motor 16 provokes a rear displacement of sliding element 14 along rod 12 (Cf. arrow F1), which generates a traction effort at end 18A of the damper rod 18. Said traction effort is transmitted at end 18B which, in turn, is converted into a rotation of bucket 83 thanks to a well-known set of connecting rods/linkages (Cf. arrows R2 and R3).

Inversely, rotation of the E-motor 16 in opposite direction leads to a forth displacement of sliding element 14 along rod 12. Thrust effort from sliding element 14 is converted into an effort applied at end 18A of the sliding element 18, which, in turn, is transmitted at end 18B. This effort at end 18B is converted into a rotation of bucket 83 thanks to said set of connecting rods/linkages.

In the alternative embodiment of FIG. 4, damper rod 18 consists of two parts between which is interposed a deformable member capable of absorbing shocks, such as elastic element, rubber cushion, fluid chamber or spring arrangement. A first part comprises first end 18A, while a second part comprises second end 18B.

The deformable member can be compressed or extended if an excessive or brutal axial effort is applied at one end of the damper rod 18, typically in case of a shock. However, in normal operating conditions, the axial force(s) applied at the ends of the damper rod 18 do not exceed damper rod resistance (the resistance being the force at which the damper starts to retract or extend), which means that damper rod 18 behaves as a rigid bar.

For the record, the resistance of the shock absorber that is used in the electric actuators described above is superior to 10 kN, for example equals to 30 kN.

In variant, damper rod 18 retracts or extends as a function of the effort to which it is subjected to, for example following a linear rule or model.

In the embodiment of FIGS. 1 and 2, the excavator 2 includes a first actuator 10.1 for moving the boom 80, whereby the second end 18B of the damper rod is attached to a hinge A of the platform/upper frame 4. The excavator 2 further includes a second actuator 10.2 for moving the dipper 82, whereby the second end 18B of the damper rod is attached to a hinge B of the dipper 82 and a third actuator 10.3 for moving the tool 83, whereby the second end 18B of the damper rod is attached to a hinge C of the tool 83.

Accordingly, in the embodiment of FIGS. 1 and 2, said first element can be the upper frame 4, the dipper 82 or the tool 83.

In the example of FIG. 2, the hinges B and C to which are attached the second ends 18B of damper rods 18 are part of the element to be actuated, while hinge A belongs to another element, resp. the upper frame 4.

Advantageously, at least the electric motor 16, the rod 12 and the sliding member 14 are integrated, and then protected into a second element of the construction equipment, such as the boom 80 or dipper 82. Accordingly, rod axis X12 is fixed/immobile relative to said second element. More precisely, the only degree of freedom of rod 12 relative to second element is the rotation about its own axis X12.

Preferably, said second element is part of the metallic structure of the construction equipment 2. As its name indicates, the metallic structure, or carcass, is an assembly of pieces of metal making up the framework of the construction equipment 2.

For instance, upper frame 4 and excavator arm 8 are part of the metallic structure of construction equipment 2. Basically, the metallic structure can be formed by metallic sheets joined together.

Besides, and in order to avoid any confusion or misunderstanding, it is clear that the first and second elements of the construction equipment, to which it is referred to above, are two distinctive elements, which means that it is not one and the same element since they move relative to each other thanks to the actuator(s).

In the embodiment of FIGS. 2, 3 and 4, elements 12, 14 and 16 of actuators 10.1 and 10.2 are integrated into the boom 80 as second element and elements 12, 14 and 16 of actuator are integrated into the dipper 82 as second element.

By the expression "integrated into", it is meant that elements 12, 14 and 16 of each actuator are housed or encased inside a sort of protective shield, which is actually part of the machine framework.

In the example of an excavator, the boom 80 and dipper 82 are traditionally made from steel plates, potentially associated to casted parts, which delimit an unused hollow volume. The idea here is therefore to use this unused hollow volume to house at least the electric motor 16, the carriage 14 and the rod 12, in order to protect these elements from external aggression, such as rocks falling. It is therefore understandable that, structurally, the carcass of the excavator 2 according to the disclosure which could be described as "100% electric" is similar to that of a traditional hydraulic excavator, except that openings are created to allow passage of damper rod 18.

Advantageously, each actuator also includes guide means (not shown) to guide the movement of the sliding element 14 along the longitudinal axis X12. These guide means can take several forms, including a basic form in which the guidance is actually provided by the second element 80 or 82 to which it is referred to above. Specifically, sliding element 14 has a cross-section approximately the same as that of said second element 80 or 82, so that rudimentary guidance is achieved.

In the example shown in FIG. 3, sliding element 14 and rod 12 form a helical link. The helical link, or connection, is achieved by contact between two helical surfaces.

For instance, this helical link is achieved by using a ball screw or roller screw mechanism (not shown). The principle of this mechanism is to use rolling elements, such as balls or rollers, to limit friction between the rod 12 and the sliding element 14. As this type of helical connection is well known from the state of the art, no further details are given here.

According to a variant not shown, the actuator to which it is referred to in this paper could be used to move the articulated blade of a construction equipment, such as excavator or loader. In known manner, the blade is fastened to the lower frame of the vehicle, typically to the front for pushing material: soil, sand, snow, rubble, or rock during construction or conversion work. In this particular embodiment, lower frame of the excavator or loader can be considered as the "second element" to which it is referred to in this paper.

The invention claimed is:

1. A construction equipment including a first element comprising one or more of a platform, an arm, and a tool and a second element comprising one or more of a boom and the arm, wherein when the second element comprises the boom, the first element comprises the platform or the arm, wherein when the second element comprises the arm, the first element comprises the tool, the construction equipment further including at least one electric actuator comprising an electric motor and a mechanism configured to transmit a torque from the electric motor to the boom, the arm, or the tool of the construction equipment in order to move the boom, the arm, or the tool in a desired direction, wherein said mechanism includes a rod extending along a longitudinal axis, a sliding member configured for moving along the rod upon activation of the electric motor, and a damper rod configured to absorb shock applied to the construction equipment, wherein the damper rod comprises a first end configured to articulate on the sliding member and a second end configured to articulate on the first element of the construction equipment to move the first element relative to the second element or vice versa, and wherein the rod, sliding member, and electric motor are housed into a hollow volume delimited in the boom or arm of the second element, the second element having a passage for the damper rod.

2. The construction equipment according to claim 1, further comprising guiding means for guiding the movement of the sliding member along the longitudinal axis.

3. The construction equipment according to claim 1, wherein the damper rod consists of two imbricated cylinders or tubes.

4. The construction equipment according to claim 1, wherein the damper rod consists of two parts between which is interposed a deformable member capable of absorbing shocks.

5. The construction equipment according to claim 1, wherein the damper rod is configured so that it can retract and/or extend depending on a shock direction.

6. The construction equipment according to claim 1, wherein the damper rod is configured so that it retracts or extends only if axial effort to which it is subjected to exceeds a specific threshold.

7. The construction equipment according to claim 6, wherein the damper rod acts as a rigid bar when no axial effort is applied or when axial effort is below the specific threshold.

8. The construction equipment according to claim 1, wherein the damper rod retracts or extends as a function of the effort to which it is subjected to.

9. A construction equipment comprising:

a first element comprising a platform, an arm, and a tool;

a second element comprising a boom;

an electric actuator comprising:

an electric motor disposed within the second element; and a transmission mechanism configured to transmit a torque from the electric motor to the boom in order to move the boom in a desired direction, the mechanism comprising:

a rod disposed within the second element, the rod extending along a longitudinal axis;

a sliding member disposed within the second element the sliding member configured for moving along the rod in response to activation of the electric motor; and a damper rod configured to absorb shock applied to the construction equipment, the damper rod comprising:

a first end configured to articulate on the sliding member; and a second end configured to articulate on the first element of the construction equipment to move the first element relative to the second element or vice versa, and wherein the rod, sliding member, and electric motor are house into a hollow volume delimited in the boom of the second element, the second element having a passage for the damper rod.

10. A construction equipment comprising:

a first element comprising a platform, and a tool;

a second element comprising an arm, an electric actuator comprising:

an electric motor housed or encased inside the second element; and a transmission mechanism configured to transmit a torque from the electric motor to a boom in order to move the boom in a desired direction, the mechanism comprising:

a rod housed or encased inside the second element, the rod extending along a longitudinal axis;

a sliding member housed or encased inside the second element, the sliding member configured for moving along the rod in response to activation of the electric motor; and a damper rod configured to absorb shock applied to the construction equipment, the damper rod comprising:

a first end configured to articulate on the sliding member; and a second end configured to articulate on the first element of the construction equipment to move the first element relative to the second element or vice versa, wherein the rod, sliding member, and electric motor are housed into a hollow volume delimited in the arm of the second element, the second element having a passage for the damper rod.

* * * * *